United States Patent [19]

Dickakian

[11] Patent Number: 4,464,248

[45] **Date of Patent: * Aug. 7, 1984**

[54] PROCESS FOR PRODUCTION OF CARBON ARTIFACT FEEDSTOCKS

[75] Inventor: Ghazi Dickakian, Scotch Plains, N.J.

[73] Assignee: Exxon Research & Engineering Co., Florham Park, N.J.

[ * ] Notice: The portion of the term of this patent subsequent to Jun. 2, 1998 has been disclaimed.

[21] Appl. No.: 291,986

[22] Filed: Aug. 11, 1981

[51] Int. Cl.[3] ..... C10C 1/20; C10C 1/18; C10C 3/08

[52] U.S. Cl. ..... 208/44; 208/40; 208/39; 423/447.4

[58] Field of Search ..... 208/44, 40, 39, 96

[56] References Cited

U.S. PATENT DOCUMENTS

| | | | |
|---|---|---|---|
| 4,042,486 | 8/1977 | Asano et al. | 208/44 |
| 4,184,942 | 1/1980 | Angier et al. | 208/44 |
| 4,208,267 | 6/1980 | Diefendorf et al. | 208/45 |
| 4,219,404 | 8/1980 | Dickakian | 208/39 |
| 4,271,006 | 6/1981 | Dickakian | 208/40 |
| 4,341,621 | 7/1982 | Fitzgerald | 208/45 |

FOREIGN PATENT DOCUMENTS

| | | | |
|---|---|---|---|
| 1891474 | 1/1972 | Canada | 208/44 |
| 16661 | 10/1980 | European Pat. Off. | 208/44 |
| 1899598 | 6/1962 | United Kingdom | 208/44 |
| 2045798 | 11/1980 | United Kingdom . | |

*Primary Examiner*—Delbert E. Gantz
*Assistant Examiner*—Helane E. Maull

[57] ABSTRACT

A process for converting cat cracker bottoms to a feedstock suitable for carbon artifact manufacture, especially carbon fiber manufacture, is provided. Basically, the cat cracker bottom is stripped of fractions boiling below about 400° C., catalytically heat soaked at temperatures below about 410° C., and then vacuum stripped to provide a pitch. The pitch is subsequently treated to remove high melting solids, such as ash, coke and catalyst fines.

3 Claims, No Drawings

PROCESS FOR PRODUCTION OF CARBON ARTIFACT FEEDSTOCKS

FIELD OF THE INVENTION

This invention relates generally to the production of useful materials from cat cracker bottoms and more particularly with the preparation of a feedstock for carbon artifact manufacture.

BACKGROUND OF THE INVENTION

As is well known, the catalytic conversion of virgin gas oils containing aromatic, naphthenic and paraffinic molecules results in the formation of a variety of distillates that have ever-increasing utility and importance in the petrochemical industry. The economic and utilitarian value, however, of the residual fraction of the cat cracking process has not increased to the same extent as has the light overheads fractions. One potential use for such cat cracker bottoms is in the manufacture of carbon artifacts. As is well known, carbon artifacts have been made by pyrolyzing a wide variety of organic materials. Indeed, one carbon artifact of particularly important commercial interest today is carbon fiber. Hence, particular reference is made herein to carbon fiber technology. Nevertheless, it should be appreciated that this invention has applicability to carbon artifact formation generally, and, more particularly, to the production of shaped carbon articles in the form of filaments, yarns, films, ribbons, sheets and the like.

Referring now in particular to carbon fibers, suffice it to say that the use of carbon fibers in reinforcing plastic and metal matrices has gained considerable commercial acceptance where the exceptional properties of the reinforcing composite materials, such as their higher strength to weight ratio, clearly offset the generally higher costs associated with preparing them. It is generally accepted that large scale use of carbon fibers as a reinforcing material would gain even greater acceptance in the marketplace if the costs associated with the formation of the fibers could be substantially reduced. Thus, the formation of carbon fibers from relatively inexpensive carbonaceous pitches has received considerable attention in recent years.

Many carbonaceous pitches are known to be converted at the early stages of carbonization to a structurally ordered optically anisotropic spherical liquid crystal called mesophase. The presence of this ordered structure prior to carbonization is considered to be a significant determinant of the fundamental properties of any carbon artifact made from such a carbonaceous pitch. Indeed, the ability to generate high optical anisotropicity during processing is accepted, particularly in carbon fiber production, as a prerequisite to the formation of high quality products. Thus, one of the first requirements of a feedstock material suitable for carbon artifact manufacture, and particularly carbon fiber production, is its ability to be converted to a highly optical anisotropic material.

In addition to being able to develop a highly ordered structure, suitable feedstocks for carbon artifact manufacture, and in particular carbon fiber manufacture, should have relatively low softening points rendering them suitable for being formed and shaped into desirable articles. Thus, in carbon fiber manufacture, a suitable pitch which is capable of generating the requisite highly ordered structure also must exhibit sufficient viscosity for spinning. Unfortunately, many carbonaceous pitches have relatively high softening points. Indeed, incipient coking frequently occurs in such materials at temperatures where they have sufficient viscosity for spinning. The presence of coke, however, or other infusible materials and/or undesirable high softening point components generated prior to or at the spinning temperatures are detrimental to processability and are believed to be detrimental to product quality. Thus, for example, U.S. Pat. No. 3,919,376 discloses the difficulty in deforming pitches which undergo coking and/or polymerization at the softening temperature of the pitch.

Another important characteristic of the feedstock for carbon artifact manufacture is its rate of conversion to a suitable optically anisotropic material. For example, in the above-mentioned U.S. patent, it is disclosed that 350° C. is the minimum temperature generally required to produce mesophase from a carbonaceous pitch. More importantly, however, is the fact that at least one week of heating is necessary to produce a mesophase content of about 40% at that minimum temperature. Mesophase, of course, can be generated in shorter times by heating at higher temperatures. However, as indicated above, at higher temperatures in excess of about 425° C., incipient coking and other undesirable side reactions do take place which can be detrimental to the ultimate product quality.

According to U.S. Pat. No. 4,042,486 the mesophase content of a pitch can be increased by heating finely divided pitch particles which have been pretreated to prevent agglomeration. Among the materials reported as suitable in preventing agglomeration of the finely divided particles are thermosetting resins, metals and metals salts.

As indicated previously, the presence of metals and metal salts is undesirable, however, at least in carbon fiber production. Indeed, in U.K. Patent Application No. 2,045,798A, a pitch suitable for carbon fiber production is produced by nitrating a tar and heating the mixture to promote polycondensation reactions thereby avoiding the presence of quinoline insoluble materials and ash normally associated with polycondensation reactions promoted by the use of catalysts such as aluminum chloride.

Recently in U.S. Pat. No. 4,208,267, it has been disclosed that typically graphitizable carbonaceous pitches contain a separable fraction which possess very important physical and chemical properties insofar as carbon fiber processing is concerned. Indeed, the separable fraction of the typical graphitizable carbonaceous pitches exhibits a softening range and viscosity suitable for spinning and has the ability to be converted rapidly at temperatures in the range generally of from about 230° C. to about 400° C. to an optically anisotropic deformable pitch containing greater than 75% of a liquid crystalline type structure. Unfortunately, the amount of separable fraction present in well known commercially available petroleum pitches, such as Ashland 240 and Ashland 260, to mention a few, is exceedingly low. For example, with Ashland 240, no more than about 10% of the pitch constitutes a separable fraction capable of being thermally converted to a deformable anisotropic phase.

In U.S. Pat. No. 4,184,942, it has been disclosed that the amount of that fraction of typical graphitizable carbonaceous pitches that exhibits a softening point and viscosity which is suitable for spinning and which has the ability to be rapidly converted at low temperatures to a highly optically anisotropic deformable pitch can be increased by heat soaking the pitch, for example, at temperatures in the range of 350° C. to 450° C., until spherules visible under polarized light begin to appear in the pitch. The heat soaking of such pitch results in an increase in the amount of the fraction of the pitch capable of being converted to an optically anisotropic phase.

In U.S. Pat. No. 4,219,404, it has been disclosed that polycondensed aromatic oils present in isotropic graphitizable pitches are generally detrimental to the rate of formation of highly optically anisotropic material in such feedstocks when they are heated at elevated temperatures and that, in preparing a feedstock for carbon artifact manufacture, it is particularly advantageous to remove at least a portion of the polycondensed aromatic oils normally present in the pitch simultaneously, with, or prior to, heat soaking of the pitch for converting it into a feedstock suitable for carbon artifact manufacture.

In copending application Ser. No. 23,753, filed Mar. 26, 1979, yet another process is disclosed for increasing that fraction of the carbonaceous isotropic graphitizable pitch which is suitable for a carbon artifact manufacture which process basically requires heating a carbonaceous isotropic graphitizable pitch with a dealkylation catalyst in the presence of an organic solvent system having a solubility parameter of 25° C. and between about 8.0 to about 9.5.

In U.S. Pat. No. 4,271,006, a process is disclosed for heat soaking, preferably at 410° C. to 420° C., a vacuum or steam stripped cat cracker bottom to provide a feedstock suitable for carbon artifact manufacture.

In any event, the foregoing references are indicative of the continuing search for feedstocks suitable for carbon artifact manufacture and particularly carbon fiber manufacture.

SUMMARY OF THE INVENTION

It has now been discovered that the residual material from catalytic cracking processes, for example, cat cracker bottoms boiling in the range from about 200° C. to 550° C., can be readily converted to a feedstock suitable for carbon artifact manufacture by catalytically heat soaking at temperatures below about 410° C. a cat cracker bottom which has been pretreated so as to remove those fractions present in the cat cracker bottom which boil below 400° C. Thereafter, the catalytic heat soaked mixture is treated so as to remove at least a portion of the aromatic oils present in the heat soaked mixture and to remove mineral, catalyst and coke particles.

A full appreciation of all the ramifications of the present invention will be more readily understood upon a reading of the detailed description which follows.

DETAILED DESCRIPTION

The term catalytic cracking refers to a thermal and catalytic conversion of gas oils, particularly virgin gas oils, boiling generally between about 316° C. and 566° C., into lighter, more valuable products.

Cat cracker bottoms refer to that fraction of the product of the cat cracking process which boils in the range from about 200° C. to 550° C.

Heat soaking is the exposure of a cat cracker bottom to elevated temperatures, for example, 350° C. to about 450° C., for a relatively long period of time to increase the aromaticity and the amount of compounds that are insoluble in toluene.

Catalytic heat soaking for the purpose of this application is the exposure of the cat cracker bottom to temperatures below about 410° C., for example, temperatures in the range of about 350° to 410° C., for a relatively short period of time in the presence of dealkylation catalysts, such as Lewis acids, Lewis acid salts, and heavy metal halides suitable for promoting polycondensation reactions.

Cat cracker bottoms typically have relatively low aromaticaity insofar as when compared with graphitizable isotropic carbonaceous pitches suitable in carbon artifact manufacture.

Specifications for a typical cat cracker bottom that is suitable in the present invention are given in Table I.

TABLE I

| | Range |
|---|---|
| Physical Characteristics | |
| Viscosity cst at 210° F. | 1.0–10.0 |
| Ash content, wt. % | 0.010–2.0 |
| Coking value (wt. % at 550° C.) | 6.0–18.0 |
| Asphaltene (n-heptane insoluble), % | 0.1–12.0 |
| Toluene insolubles (0.35μ), % | 0.010–1.0 |
| Number average mol. wt. | 220–290 |
| Elemental Analysis | |
| Carbon, % | 88.0–90.32 |
| Hydrogen, % | 7.74–7.40 |
| Oxygen, % | 0.10–0.30 |
| Sulfur, % | 1.0–4.5 |
| Chemical Analysis (proton NMR) | |
| Aromatic carbon (atom %) | 54–64 |
| Carbon/hydrogen atomic ratio | 0.90–1.0 |
| Asphaltene Analysis | |
| Number average mol. wt. | 550–700 |
| Coking value, wt. % at 550° C. | 55–65 |
| Aromatic carbon (atom %) | 55–70 |
| Bureau of Mines Correlation Index | 120–140 |

In the conversion of vacuum of steam stripped cat cracker bottoms to pitches having high optical anisotropicity, the temperature of heat soaking has been found to be an important determinant of the product characteristics. Heat soaking temperatures above about 410° C. tend to produce anisotropic pitches having relatively low softening points. Unfortunately, high heat soaking temperatures, i.e., temperatures above about 410° C., necessitate more expensive processing equipment and higher energy costs than lower heat soaking temperatures. Higher temperatures also result in undesired increased yields of coke and other quinoline insoluble substances. Catalytic heat soaking of the present invention therefore provides signficant advantages as will be appreciated from a complete reading of this specification.

In the process of the present invention, a cat cracker bottom is heated to a temperature generally in the range of about 250° C. to about 380° C., and preferably at 280° C. to 350° C., while maintaining the so-heated cat cracker bottom under reduced pressure, for example, between 5 to about 75 mm Hg, thereby effecting vacuum stripping of the cat cracker bottom.

In an alternate embodiment of the present invention, the cat cracker bottom is treated with steam at temperatures generally in the range of 300° C. to 380° C., thereby effectively removing those fractions present in the pitch boiling below about 400° C.

In either the case of vacuum stripping or steam stripping, the process is continued until at least a part of the low boiling fractions present in the cat cracker bottom are removed. Indeed, it is preferred to remove substantially all of the low boiling fractions present. Thus, from about 10% to about 90% of the low boiling fractions of the cat cracker bottom are generally removed in accordance with the process of this invention.

After removing the low boiling fractions, i.e., those fractions boiling generally below about 400° C., the so-treated cat cracker bottom is heat soaked in the presence of a dealkylation catalyst. Optionally, and preferably, heat soaking is conducted at temperatures below about 410° C., for example, in the range of about 350° C. to 410° C., and preferably at 380° C. to about 390° C. for times ranging from about ¼ to 5 hours, and preferably for about 1 to 3 hours. As indicated, heat soaking is conducted in the presence of dealkylation catalyst, such as Lewis acids, Lewis acid salts and heavy metal halides. Typical heavy metal halides suitable in the practice of the present invention include heavy metal chlorides, such as zinc chloride, ferrous and ferric chloride, cuprous and cupric chloride. Typical Lewis acids that are suitable include such materials as aluminum chloride, borontrifluoride and the like. Typical Lewis acid salts include etherates and aminates of borontrifluoride and the like.

The amount of catalyst used in the practice of the present invention is not critical and may vary over a relatively wide range, for example, from about 0.10 wt. % based on the weight of vacuum or steam stripped cat cracker bottom to about 1.0 wt. %. Nonetheless, it is generally preferred to use from about 0.25 wt. % to about 0.50 wt. % of the dealkylation catalyst based on the weight vacuum or steam stripped cat cracker bottom.

After the catalytic heat soaking of the vacuum or steam stripped cat cracker bottom, the mixture is then heated in vacuum at temperatures generally below about 400° C., and typically in the range of about 300° to 370° C., at pressures below atmospheric pressure, generally in the range from about 1.0 to 3.0 mm Hg, to remove at least a portion of the oil present in the resultant mixture. Typically from about 20% to about 35% of the oil present in the mixture is removed. Optionally, of course, all of the aromatic oils may be so removed.

As will be readily appreciated, the pitch produced in accordance with the foregoing process will contain materials insoluble in quinoline at 75° C. This quinoline insoluble material may consist of coke, ash, catalyst fines, and high softening point materials generated during heat soaking. Consequently, after removing the oil from the catalytic heat soaked vacuum or steam stripped cat cracker bottom undesirable high softening point components present in the resultant mixture are removed. A particularly preferred technique for removing these components is disclosed in copending application Ser. No. 29,760 filed Apr. 13, 1979, which application is incorporated herein by reference. Basically, the catalytic heat soaked and de-oiled pitch is fluxed, that is, it is treated with an organic liquid in the range, for example, of from about 0.5 parts by weight of organic liquid per weight of pitch to about 3 parts by weight of fluxing liquid per weight of pitch, thereby providing a fluid pitch having substantially all the quinoline insoluble materials (including inorganic matter) suspended in the fluid in the form of readily separable solids. The suspended solids are then separated by filtration or the like, and the fluid pitch is then treated with an antisolvent, i.e., an organic liquid or mixture of organic liquids capable of precipitating and flocculating at least a substantial portion of the pitch free of quinoline insoluble solids.

As will be appreciated, any antisolvent which will precipitate and flocculate the fluid pitch can be employed in the practice of the present invention. However, since it is particularly desirable in carbon fiber manufacture to use that fraction of the pitch which is readily convertible into an optically anistropic phase and which has a low softening point and viscosity suitable for spinning, the antisolvent employed for precipitating the desired pitch fraction generally is selected from aromatic and alkyl substiuted aromatic hydrocarbons and cyclic ethers and mixtures thereof. Examples of aromatic and alkyl substituted aromatic hydrocarbons include benzene, toluene, xylene, naphthalene, ethylbenzene, mesitylene, bi-phenyl and tetrahydronaphthalene. Representative examples of halogen substituted aromatic hydrocarbons include chlorobenzene, trichlorobenzene, bromobenzene, orthodichlorbenzene, trichlorobiphenyl. Representative examples of cyclic ethers include furan and dioxane. Representative examples of mixtures of antisolvents include mixtures of compounds such as coal tar distillates, light aromatic gas oils and heavy aromatic gas oils.

The amount of solvent employed will be sufficient to provide a solvent insoluble fraction capable of being thermally converted to an optically anisotropic material. Generally from about 1 part of pitch to 4 parts of solvent to about 1 part by volume of pitch to about 16 parts by volume of solvent, depending upon the type of solvent, will be employed. After precipitating and flocculating the pitch, the pitch is separated as a solvent insoluble fraction by typical techniques such as sedimentation, centrifugation, filtration and the like.

A more complete understanding of the process of this invention can be obtained by reference to the following examples which are illustrative only and are not meant to limit the scope thereof which is fully disclosed in the hereinafter appended claims.

EXAMPLE 1

In this example, a cat cracker bottom having the following physical inspections was used.

TABLE II

| | |
|---|---|
| Physical Characteristics | |
| Viscosity cst at 210° F. | = 15.1 |
| Ash content, wt. % | = 0.050 |
| Coking value (wt. % at 550° C.) | = 6.0 |
| Asphaltene (n-heptane insolubles), % | = 1.0 |
| Toluene insolubles (0.35μ), % | = 0.200 |
| Number average mol. wt. | = 280 |
| Elemental Analysis | |
| Carbon, % | = 90.32 |
| Hydrogen, % | = 7.40 |
| Oxygen, % | = 0.10 |
| Sulfur, % | = 2.0 |
| Chemical Analysis (by proton NMR) | |
| Aromatic carbon (atom %) | = 65 |
| Carbon/hydrogen atomic ratio | = 1.01 |
| Asphaltene Analysis | |
| Number average mol. wt. | = 700 |
| Coking value (at 550° C.), % | = 55.0 |
| Bureau of Mines Correlation Index | = 122 |

The cat cracker bottom was charged into a reactor which was electrically heated and equipped with a mechanical agitator. To the cat cracker bottom was added the 1% by wt. of anhydrous aluminum chloride and the mixture was catalytic heat soaked under nitrogen atmosphere at 390° C. for 1 hour. Then the mixture was cooled to around 380° C. and vacuum stripped at 1.0 mm Hg to remove all the distillable oils present in the mixture.

Representative samples of the catalytic heat soaked cat cracker bottom were then further treated by refluxing the catalytic heat soaked cat cracker bottom with an equal part by weight of a fluxing agent so as to render the pitch fluid. The solids suspended in the fluid pitch were then removed by filtration. The filtrate was then added to an antisolvent to precipitate and flocculate the pitch after which the precipitate was separated by filtration and dried in vacuum at 160° C. for 20 hours.

The optical anisotropicity of the carbon precursor product was determined by first heating the product to its softening point and then, after cooling, placing a sample of the pitch on a slide with Permount, a histiological mounting medium sold by Fisher Scientific Company, Fairlawn, N.J. A slip cover was placed over the slide and, by rotating the cover under hand pressure, the mounted sample was crushed to a powder and evenly dispersed on the slide. Thereafter the crushed sample was viewed under polarized light at a magnification factor of 200× and the percent optical anisotropicity was estimated.

The reaction conditions and the results of the foregoing tests are set forth in Table III below.

EXAMPLE 2

A cat cracking bottom having the physical inspections as set forth in Example 1 was introduced into a reactor and heated to 335° C. and a pressure of 75 mm Hg to remove about 40% of the distillable oils present in the cat cracker bottom. Representative samples of the vacuum stripped cat cracker bottom were subsequently heat soaked at atmospheric pressure under a nitrogen atmosphere in the presence of 1 wt. % anhydrous aluminum chloride for times and temperatures shown in Table IV. After heat soaking, the samples were cooled to around 380° C. and the pressure was reduced to 1.0–3.0 mm Hg and all of the distillable oils were removed. After cooling to room temperature under nitrogen atmosphere, representative samples of the resultant material were fluxed and the fluxed insoluble solids separated by filtration. The filtrates from each sample were then precipitated using the procedures of Example 1. The details of the fluxing and the results and data for the materials are given in Table IV below.

EXAMPLE 3

By the way of comparison, samples of a vacuum stripped cat cracker bottom were heat soaked at 400° C. for three hours under 75 mm Hg in the absence of a catalyst. Thereafter, the heat soaked cat cracker bottom was fluxed, filtered and precipitated as outlined in the preceding examples. The conditions and results are set forth in Table V below. In these runs, the product did not show any indication of softening at 375° C. and, hence, the softening point is indicated as being greater than 375° C. and, from experience, would be expected to be above about 400° C.

TABLE III

| | | | | | Product Characteristics | | | |
|---|---|---|---|---|---|---|---|---|
| Sample | Flux Solvent | Flux Pitch:Solvent | Antisolvent | Antisolvent Pitch:Solvent | % Product | Melting Point °C. | Optical Activity % | Viscosity poise @ 360° C. |
| 1 | Toluene | 1:1 | Toluene | 1:8 | 17.8 | 275–300 | 100 | 839 |
| 2 | Tetrahydrofurane | 2:1 | Toluene | 1:16 | 25.9 | 300–325 | 100 | — |
| 3 | Trichlorobenzene | 1:1 | Toluene | 1:16 | 35.5 | 300–325 | 100 | — |
| 4 | Chlorobenzene | 1:1 | Toluene | 1:16 | 25.6 | 300–325 | 100 | 1444 |

TABLE IV

| | Heat Soaking Conditions | | | Fluxing Data | | | | Product Characteristics | | |
|---|---|---|---|---|---|---|---|---|---|---|
| Sample | Temperature (°C.) | Time (min) | $AlCl_3$ wt. % | Flux Solvent | Flux Pitch:Solvent | Anti-solvent | Pitch: Anti-solvent | Product Yield % | Melting Point, °C. | Optical Activity, % |
| 5 | 390 | 60 | 1.0 | Chlorobenzene | 1:1 | Toluene | 1:8 | 25.6 | 300–325° | 100 |
| 6 | 400 | 60 | 1.0 | Trichlorobenzene | 1:1 | Toluene | 1:16 | 35.5 | 300–325° | 100 |

TABLE V

| | Fluxing Data | | | | Product Characteristics | | |
|---|---|---|---|---|---|---|---|
| Sample | Flux Solvent | Flux:Solvent Ratio | Antisolvent | Anti-Solvent:Pitch Ratio | % Product | Precursor Melting Point (°C.) | % Optical Activity |
| 7 | Tetrahydrofuran | 1:1 | Toluene | 1:8 | 24.4 | >375 | >75 |
| 8 | Chlorobenzene | 1:1 | Toluene | 1:8 | 27.8 | >375 | >75 |

What is claimed is:

1. A process for preparing a feedstock suitable for carbon fiber production comprising:

(1) treating a cat cracker bottom which boils in the range from about 100° C. to about 550° C. to remove from about 10% to about 90% by weight of the fractions present in said cat cracker bottom which boil below about 400° C.;

(2) adding a dealkylation catalyst in amounts ranging from about 0.1 weight percent to about 1.0 weight percent to said treated cat cracker bottom of step 1, said dealkylation catalyst being selected from the group consisting of Lewis acid, Lewis acid salts and heavy metal halides;

(3) heating said mixture from step 2 above at temperatures ranging from about 350° C. to about 410° C. for times ranging from about ¼ to about 5 hours;

(4) vacuum stripping the resultant mixture from step 3 at temperatures in the range from about 300° C. to about 370° C., at pressures ranging from about 1.0 to about 3 mm of Hg to remove at least a portion of the aromatic oils present in said catalytic heat soaked pitch;

(5) adding an organic fluxing liquid to said vacuum stripped pitch to provide a fluid pitch containing insoluble solids suspended therein, said organic fluxing liquid being employed in the range from about 0.5 to about 3 parts by weight of liquid per part of pitch;

(6) filtering said pitch from step 5 to separate said solids;

(7) treating said separated fluid pitch from step 6 with an antisolvent selected from the group consisting of aromatic and alkyl substituted aromatic hydrocarbons, cyclic ethers and mixtures thereof in an amount sufficient to provide a solvent insoluble fraction which is capable of being thermally converted into a deformable pitch containing greater than 75% of an optically anisotropic phase; and (8) separating said solvent insoluble fraction whereby a pitch suitable for carbon fiber production is obtained.

2. The process of claim 1 wherein said dealkylation catalyst in $AlCl_3$.

3. The process of claim 2 wherein said heating of step 3 is in the range of 380° C. to 390° C.

* * * * *